US005945866A

United States Patent [19]

Fonash et al.

[11] Patent Number: 5,945,866

[45] Date of Patent: Aug. 31, 1999

[54] METHOD AND SYSTEM FOR THE REDUCTION OF OFF-STATE CURRENT IN FIELD EFFECT TRANSISTORS

[75] Inventors: Stephen J. Fonash; Xin Lin; Anand Krishnan, all of State College, Pa.; Vyshnavi Suntharalingam, Concord, Mass.

[73] Assignee: The Penn State Research Foundation, University Park, Pa.

[21] Appl. No.: 08/807,611

[22] Filed: Feb. 27, 1997

Related U.S. Application Data

[60] Provisional application No. 60/012,355, Feb. 27, 1996, and provisional application No. 60/029,750, Nov. 7, 1996.

[51] Int. Cl.[6] ..... G09G 3/36

[52] U.S. Cl. ..... 327/427; 327/567; 345/92

[58] Field of Search ..... 345/92, 96, 98, 345/100, 208, 209; 327/419, 427, 430, 431, 434, 567, 574, 579, 581

[56] References Cited

U.S. PATENT DOCUMENTS

| | | | |
|---|---|---|---|
| 4,870,396 | 9/1989 | Shields | 340/719 |
| 5,526,012 | 6/1996 | Shibahara | 345/92 |
| 5,798,744 | 8/1998 | Tanaka et al. | 345/92 |
| 5,841,415 | 11/1998 | Kwon et al. | 345/90 |

OTHER PUBLICATIONS

Suntharalingam et al., "Electrically Reversible Depassivation Passivation Mechanism in Polycrystalline Si", Appl. Phys. Lett. 68, Mar. 1996, pp. 1400–1402.

Suntharalingam, Dissertation, Dec. 1996, Penn State Univ., pp. 53–59.

Hack et al., "Analysis of Leakage Currents in Polysilicon Thin Film Transistors", IEDM Technical Digest (1993), pp. 385–387.

Gopi et al., "New Degradation Mechanism Associated with Hydrogen in Bipolar Transistors under Hot Carrier Stress", Appl. Phys. Lett. 63, (1993) pp. 1237–1239.

Zhao et al. "Observation of Electromigration . . . Transistors", Appl. Phys. Lett. 62, Jun. 1993, pp. 2950–2952.

Jackson et al., "Density of gap states . . . absorption", Appl. Phys. Lett. 43, Jul. 1983, pp. 195–197.

Cartier et al., "Passivation and Depassivation . . . Hydrogen", Appl. Phys. Lett. 63, Sep. 13, 1993, pp. 1510–1512.

Street, R. A., "Hydrogen Diffusion and Electronic Metastability in Amorphous Si" Physica B170 (1991) pp. 69–81.

Lewis et al., "Active Matrix Liquid Crystal . . . TFTs", IEDM Tech. Dig. (1990) pp. 843–846.

*Primary Examiner*—Tuan T. Lam

*Attorney, Agent, or Firm*—Thomas J. Monahan

[57] ABSTRACT

A method for reducing the field dependence of an off-state current flow condition in a field-effect transistor having a source electrode, a drain electrode and a gate electrode, includes the steps of: applying a far off-state bias between the drain electrode and the gate electrode to drive a conduction channel in the field effect transistor into a far off-state; and applying a far off-state bias between the source electrode and the gate electrode to again drive the conduction channel into a far off-state; wherein both applying steps cause application of the far off-state bias for a sufficient time to reduce gate voltage dependency of off-state current flow in the conduction channel during a period when an off-state potential is applied to the gate electrode.

8 Claims, 3 Drawing Sheets

METHOD AND SYSTEM FOR THE REDUCTION OF OFF-STATE CURRENT IN FIELD EFFECT TRANSISTORS

Priority is hereby claimed from Provisional Application No. 60/012,355, filed Feb. 27, 1996; and Provisional Application No. 60/029,750, filed Nov. 07, 1996.

FIELD OF THE INVENTION

This invention relates to a system and method for reduction of off-state current in a field effect transistor and, more particularly, to a method for applying a bias stress to a field effect transistor which improves the off-state current characteristics thereof.

BACKGROUND OF THE INVENTION

The performance and reliability of thin film field effect transistors (TFTs) and solar cells that are fabricated in poly-crystalline (poly-Si) and amorphous (a-Si) silicon are limited by defects in these materials. Defects in poly-Si are primarily located in high defect density regions near interfaces and grain boundaries. Defects in a-Si are spatially distributed more uniformly than in poly-Si, though very high defect density regions can be found at interfaces between deposited layers. In TFTs, these defects provide sites for unwanted generation of carriers and result in a current flow, even when the TFT is in an off-state. These defects can also adversely affect device performance in the on-state.

Poly-Si TFTs offer not only superior field effect mobility over a-Si TFTs, but also exhibit the best overall combination of properties. However, when such poly-Si TFTs are utilized with large area displays, their off-current characteristics tend to reduce the contrast of the display. More specifically, even in the off-state, such poly-Si TFTs exhibit a current flow. Thus, when poly-Si TFTs are used to drive a large size display, such off-state current can enable the slow discharge of a capacitive charge previously applied across a display cell, such as a liquid crystal cell.

Further, as the off-state current in poly-Si TFTs is often voltage dependent, substantial efforts must be taken to set the applied off-state bias voltage within a narrow range to establish the lowest levels of off-state current.

Referring to FIG. 1, a schematic sectional diagram of a TFT 10 is illustrated that is deposited on a glass or plastic substrate 11. The particular configuration shown is a so-called top gate structure with a thin crystalline silicon layer 12 residing on a glass substrate 11 (which may or may not be coated) and, in the known manner, includes source and drain regions 14 and 16, respectively. A gate 18 is isolated from a conduction channel 20 via a dielectric layer 22.

Assuming that TFT 10 is doped to have a P-type conduction channel 20, then in a "forward biasing" mode of operation, Vs can be at ground and Vd at some negative voltage. In the off-state, a voltage +Vg, exhibiting a positive value must be applied to gate 18. Accordingly, a rather large electric field is created between gate 18 and drain region 16 in the off state. That field can enable electron-hole pairs to be created near the drain by a mechanism such as tunneling assisted generation. The resulting electrons (in the case of a P-channel TFT) can flood the channel. Such carriers enable an off-state current flow, since source and drain regions 14 and 16 are still biased to enable conduction, should carriers be present in conduction channel 20.

These generation mechanisms in the off-state are believed to occur via defects states. However, in a single crystal device, there is a low defect density and thus, a low value of off-state current. But in poly-Si TFTs, silicon layer 12 comprises a multi-crystalline structure which exhibits a substantial population of defects. Accordingly, the off-state current exhibits a higher value in multi-crystalline TFTs. Finally, a TFT's off-state current is voltage dependent and exhibits a changing value with changes in the off state bias voltage (i,e., between gate 18 and drain region 16).

It is known that the off-state field occurring between a drain and gate structure can be shaped by alteration of the doping of the drain region. Such action generally requires an angular implant (in addition to the original drain implant) to create a lightly doped drain region which reduces the strength of the off-state field. Because a second implant action is required to achieve the lightly doped drain region, expense is added as a result of the additional implant action.

Accordingly, it is an object of this invention to provide a means for reducing off-state current in a TFT.

It is another object of this invention to provide a method for tailoring the off-state current in a TFT which reduces the voltage dependency thereof.

SUMMARY OF THE INVENTION

A method for reducing the field dependence of an off-state current flow condition in a field-effect transistor having a source electrode, a drain electrode and a gate electrode, includes the steps of: applying a far off-state bias between the drain electrode and the gate electrode to drive a conduction channel in the field effect transistor into a far off-state; and subsequently applying a far off-state bias between the source electrode and the gate electrode to again drive the conduction channel into a far off-state; wherein both applying steps cause application of the far off-state bias for a sufficient time to reduce gate voltage dependency of off-state current flow in the conduction channel during a period when an off-state potential is applied to the gate electrode.

DETAILED DESCRIPTION OF THE INVENTION

Hereafter, the following terms will be utilized:

Forward mode: wherein a TFT is biased such that the source contact plays the role of the source and the drain contact plays the role of the drain.

Reverse mode: wherein a TFT is biased such that the source contact plays the role of the drain and the drain contact plays the role of the source.

Junction stress: application of a far off-state voltage across either a gate/drain junction or a gate/source junction.

It has been found that for hydrogenated, dehydrogenated and non-hydrogenated p-channel TFTs (p-TFTs) and hydrogenated and dehydrogenated n-channel TFTs (n-TFTs), application of a far off-state voltage stress between the gate and drain and the gate and source, respectively, substantially weakens the voltage dependence of off-state current flow through the TFT. Such an applied voltage stress has been found to create an effect which manifests itself for a substantial duration. Nevertheless, it is preferred that application of a far off-state stress voltage be repeated on a systematic basis so as to maintain the thus-achieved reduced values of off-state current and off-state current voltage dependence.

As will be hereafter understood, the required biasing to create a far off-state stress between the respective electrodes of a thin-film transistor is preferably applied at times such a stress voltage will not alter the function of the display. Thus, it is contemplated, in one embodiment, that a maintenance mode be employed which enables the systematic application of the stress voltages to the gate-drain and gate-source junctions to assure the retention of the improved values of off-state current.

Figure 1:
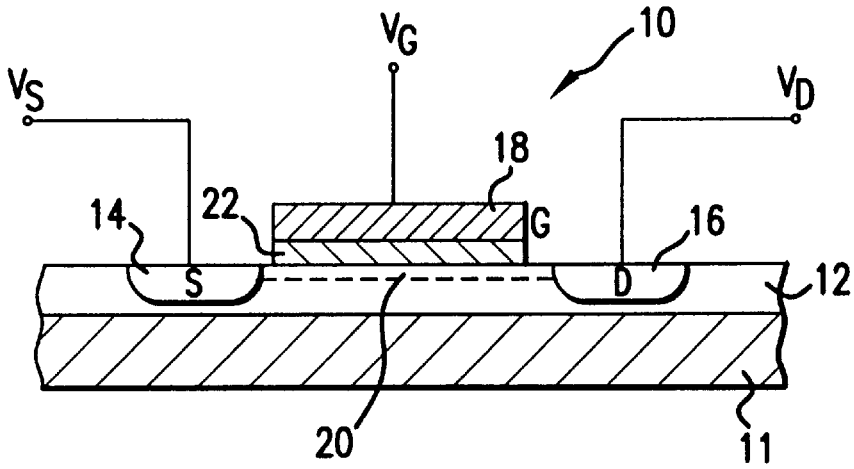
FIG. 1 is a sectional diagram of a prior art TFT.
Figure 2:
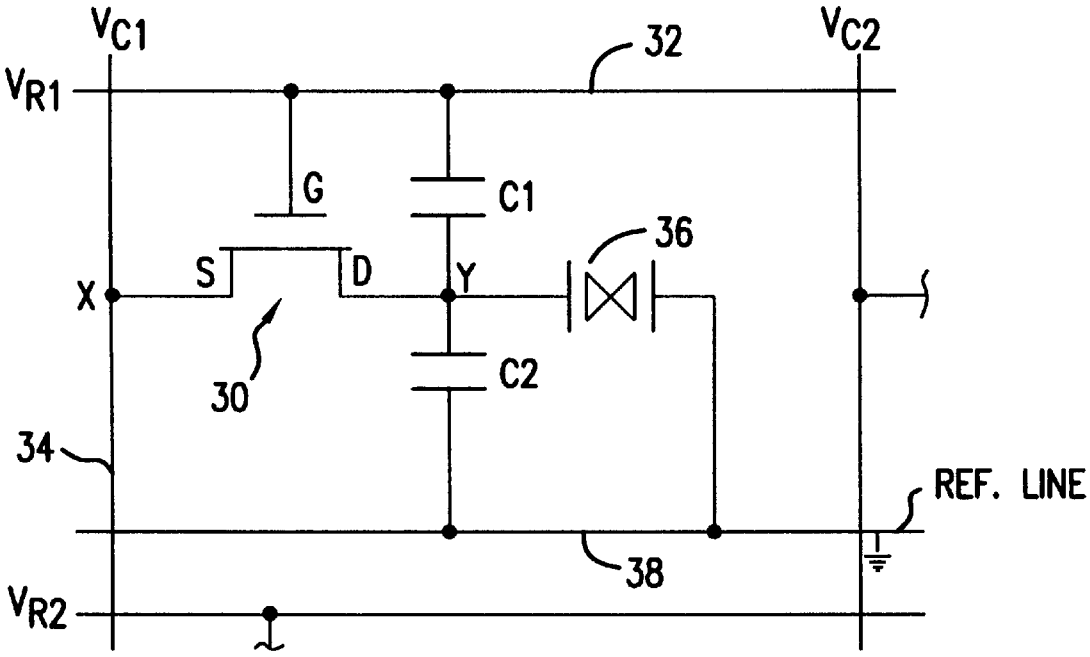
FIG. 2 is a circuit diagram of a single liquid crystal display cell, which enables application of far off-state bias voltages thereto.

Referring to FIG. 2, an exemplary display cell is shown for the case of a liquid crystal panel. The cell comprises a TFT 30 which includes gate, drain and source electrodes G, D and S, respectively. A row drive line 32 has applied thereto a row voltage Vr1. In similar manner, a column drive line 34 has applied thereto a column select voltage Vc1. Source junction S of TFT 30 is connected to column drive line 34 at node X, gate electrode G is connected to row drive line 32, and drain electrode D is connected to a node Y between capacitors C1 and C2 and one plate of a liquid crystal display element 36. The other plate of liquid crystal display element 36 is connected to a reference line 38 which is also coupled to one plate of capacitor C2. The other plate of capacitor C1 is connected to row drive line 32.

Hereafter, the terms far-off forward stress mode and far-off reverse stress mode will be utilized. The far-off forward stress mode refers to the condition that is present when voltages are applied between the gate electrode G and drain electrode D that force TFT 30 into the far off-state; i.e. wherein the current flow therethrough is at a minimum. By contrast, the far-off reverse stress mode is the condition which exists when the voltage between the gate electrode G and source electrode S is such as to again force thin film transistor 30 into the far off-state condition. As will be hereafter understood, the application of such far-off forward and reverse mode stresses renders the remnant off-state current relatively insensitive to voltage and reduces the off-state current through a TFT over at least a part of the gate's off-state voltage range.

Referring to FIG. 2, an example is illustrated of how to apply a far-off forward mode stress between gate electrode G and drain electrode D of TFT 30. Assuming that TFT 30 is a p-channel device, an initial negative potential (e.g. −10 volts) is applied to column drive line 34 and a turn-on voltage (e.g. −10 volts) is applied to row drive line 32. Accordingly, TFT 30 becomes conductive and the −10 volts appearing at node X is transferred to node Y and causes a charging of capacitor C2. During this time, and at all other times in this example, reference line 38 is grounded.

Next, the voltage on column drive line 34 is raised to ground and the voltage on row drive line 32 is raised to a high positive potential (e.g. +30 volts), putting TFT 30 in the off state. As a result of this biasing, the potential difference between gate electrode G and drain electrode 30 is 40 volts, and TFT 30 is thus subjected to a far-off state stress. After this forward far-off state stress, and for an extended period of time, the forward off-state current is largely voltage-insensitive and exhibits reduced values over a substantial range of off-state potentials.

While the precise reason underlying such off-state conduction behavior modification is not yet fully understood, it is believed that the application of the high off-state field stress creates localized states at the interface between the gate dielectric and the polycrystalline interface region of TFT 30. These localized states do not support a current flow, but rather trap electrons which produce a field shaping action at the conduction channel. Thus, when an off-state voltage is applied to gate G, after a far off-state forward mode stress action, the resulting electric field does not tend to penetrate into the p channel as much as otherwise and the voltage dependency of the forward off-state current is inhibited.

In this example, after the forward far off-state stress is applied between gate electrode G and drain electrode D, a reverse mode far off-state stress operation occurs. First, a turn-on voltage (e.g., about ten volts) is again applied to row drive line 32 and column drive line 34 is grounded. Thus, node Y is put at ground. Next, the potential on row drive line 32 is raised to approximately 30 volts and the potential on column drive line 34 is dropped to approximately −10 volts. Under such condition, a reverse far off-state stress is impressed between gate electrode G and source contact S. Thereafter, reverse mode off state current flow through thin film transistor 30 is less responsive to voltage variations and is reduced over at least part of the reverse mode off state gate voltage range.

Experimental

Both n and p channel top gate TFTs with implanted source and drain regions were used in the study (although the approach applies equally well to other gate configurations). The source and drain regions were fabricated in undoped solid phase crystallized polycrystalline silicon films of 1000 Angstroms thickness and 2 micron grain size. Hydrogenation of these devices occurred in the last step of fabrication and was performed for 2 hours, with either an electron cyclotron (ECR) or RF plasma source. The ECR hydrogen pressure was 0.26 m Torr, substrate temperature was 300° C. and microwave power was 600 W. Devices employing a 10 micron channel length and channel widths of from 5–50 microns were examined. The device characteristics were measured with a HP 4142 voltage source in two biasing configurations which, as indicated above, are termed forward mode and reverse mode. For n-channel devices, transfer characteristics were measured at drain-source voltages (Vds) of 0.1, 5 and 10 volts and the gate/source voltage (Vgs) was swept from −20 volts to +20 volts, with opposite polarities being used for p-channel devices.

The transistors were characterized and then subjected to a variety of forward mode and reverse mode stresses. These stresses comprised a variety of biasing configurations applied for variable lengths of time. In the process of the evaluation of TFT response to the electrical stresses, it was determined that far off-state stresses of appropriate magnitude and duration can cause an off-state current reduction. For example, one far off-state stress that can cause this effect in studied n-channel structures is a drain voltage of +20V (−20V for p-channel) and a gate voltage of −20V (+20V for p-channel) and grounding of the source. The devices were stressed for periods varying from 2 seconds to 1 hour, to study if OFF-current change saturation occurs.

Figure 3:
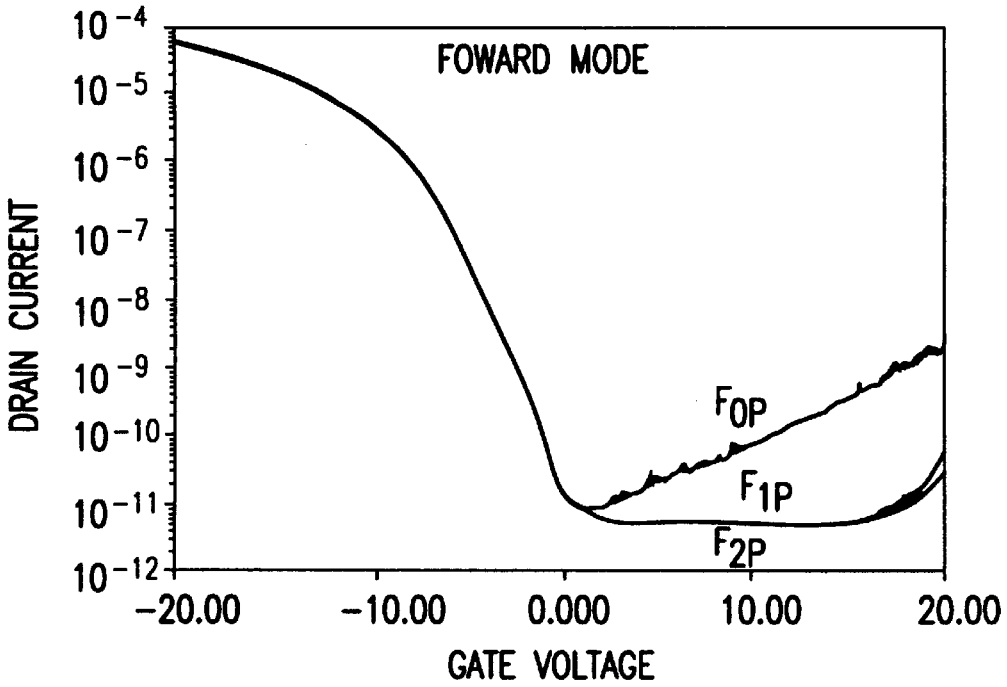
FIG. 3 illustrates forward mode transfer characteristics of a p-channel TFT before stress and after a forward far-off state stress, and after a subsequent reverse far-off state stress.
Figure 4:
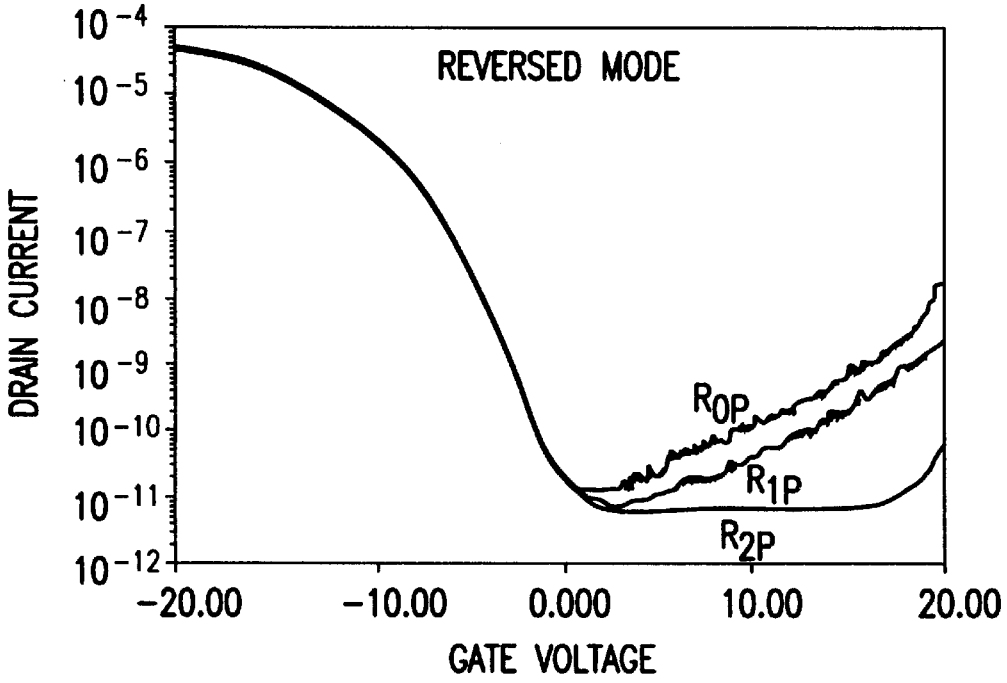
FIG. 4 is a plot of reverse mode transfer characteristics (wherein the roles of the source and drain are exchanged) of a p-channel TFT before stress and after a forward far-off state stress, and after a subsequent reverse far-off state stress.

FIG. 3 shows a typical plot $F_{0p}$ (where F refers to forward measuring mode, 0 refers to the number of stresses the sample has seen, and p refers to the type of channel) of the initial characteristics of a P-channel transistor in the forward mode of biasing (Vd=−10V; Vs=0V for p-TFTs shown). Curve $R_{0p}$ in FIG. 4 shows the initial characteristics of the transistor in the reverse mode of biasing (Vd=0; Vs=−10V for p-TFTs shown (where d & s refer to the drain and source of the forward mode).

Curve $F_{1p}$ in FIG. 3 shows the characteristics after the forward far off state stress described above. As seen, for the p-channel transistor, when the role of source and drain during a measurement are the same as they were during the stress, the parameters such as threshold voltage, sub-threshold swing and ON current do not change significantly, but the field dependence of the off-current is drastically reduced. The same effect is seen for n-channel devices also. The transfer characteristics for the reverse mode of measurement after the forward mode far off-state stress are given by curve $R_{1p}$ of FIG. 4, where R refers to reverse mode of measurement, 1 refers to the first (in this case, forward) stress, and p refers to the type of channel.

This behavior seen in curves $F_{1p}$ and $R_{1p}$ is stable with time. Measurements taken after a week still showed the reduction in off-current field dependence in the forward mode. It is very important to note that upon applying a second far off-state stress, with reverse stress orientation (source voltage, i.e., contact S, of −20V (+20V for n-channel) and a gate voltage of +20V (−20V for n-channel), the effect of the first stress is not erased (see curve $F_{2p}$), but the second stress causes a reduction in the reverse mode off-current field dependence (see curve $R_{2p}$). This change is also stable with time. Hence, after a forward and reverse mode bias stress, the forward and reverse mode transfer characteristics of n- and p-channel devices are greatly improved as seen in curve $F_{2p}$ of FIG. 3 and curve $R_{2p}$ of FIG. 4. It is seen that there is almost no field dependence of the off-current for both possible biasing modes.

Figure 5:
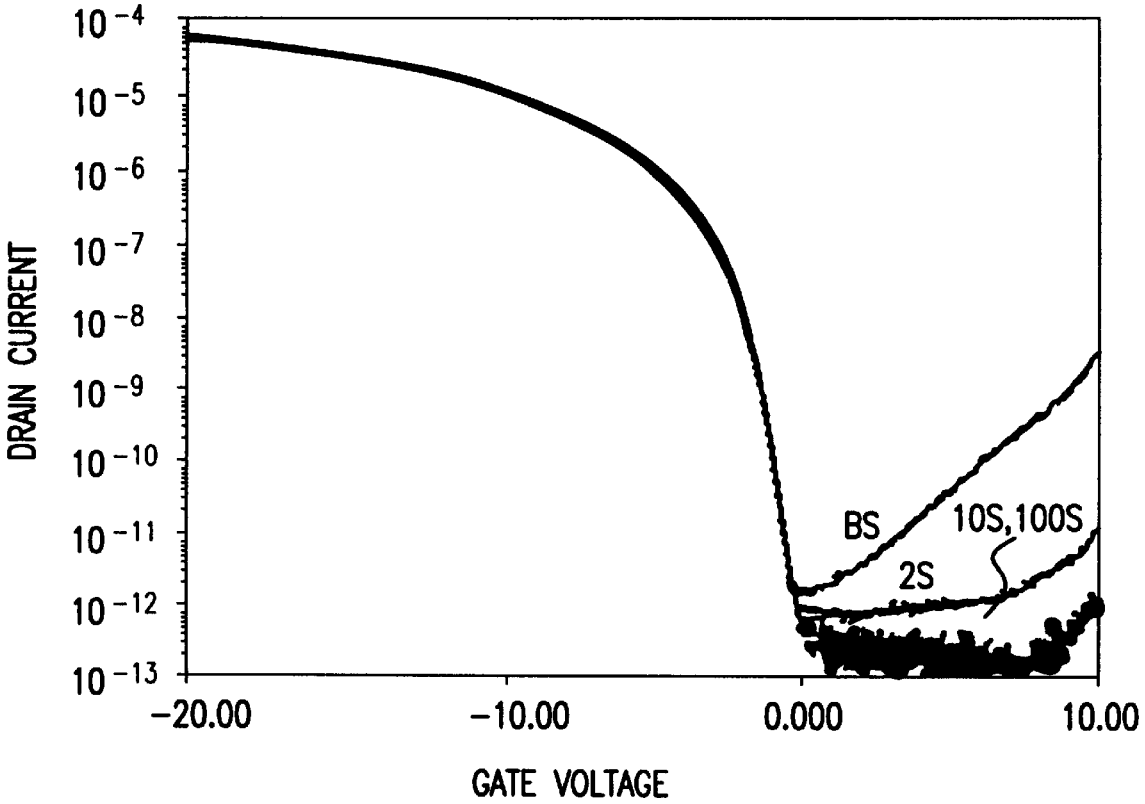
FIG. 5 is a plot illustrating the time evolution of the field dependence of the off-current for a forward far-off state stress (forward mode transfer characteristic).

It was found that this behavior saturates with time. Even a two second stress is sufficient to show this effect, while it saturates for stressing times less than a minute, for the transistors examined. For the short time stress, there was no significant change in any other characteristic such as threshold voltage, transconductance or on-current. This is shown in FIG. 5.

The electric field necessary to produce this effect of off current reduction may be applied by several approaches: the TFTs can be voltage biased (1) during processing, (2) during a heat treatment, such as a forming gas anneal, done in conjunction with or after another hydrogen passivation step, or (3) during a "pre-conditioning" step before initial operation, or (4) during device operation as a "maintenance mode" cycle. The electric field necessary for this effect of off-current reduction may also be built into the structure.

It should be understood that the foregoing description is only illustrative of the invention. Various alternatives and modifications can be devised by those skilled in the art without departing from the invention. For instance, the sequence of applied forward and reverse stresses is not critical and they may be applied in any sequence. Accordingly, the present invention is intended to embrace all such alternatives, modifications and variances which fall within the scope of the appended claims.

We claim:

1. A method for reducing field dependence of off-state current flow of a field-effect transistor having a source electrode, a drain electrode and a gate electrode, said method comprising the steps of:

a) applying a far off-state forward stress mode voltage between said drain electrode and said gate electrode to drive a conduction channel in said field effect transistor into a far off-state; and b) applying said far off-state reverse stress mode voltage between said source electrode and said gate electrode to drive said conduction channel into said far off-state again; and wherein said applying steps a) and b) cause application of said far off-state voltages for a sufficient time to reduce gate voltage dependency of off-state current flow in said conduction channel.

2. The method as recited in claim 1 wherein steps a) and b) are performed in a repeated manner.

3. The method as recited in claim 1 wherein said field effect transistor is configured as a thin film transistor and said source electrode and drain electrode connect to doped regions in a polycrystalline semiconductor layer.

4. A method for reducing field dependence of off-state current flow of a field-effect transistor having a source region, a drain region and a gate electrode, said field effect transistor connected in a circuit, said method comprising the steps of:

a) applying bias voltages to at least said source region and gate electrode to cause said transistor to achieve both on-state and off-state conditions during ordinary operation of said circuit; and b) repeatedly applying a far off-state voltage between at least one of said source and drain regions and said gate electrode to drive said field effect transistor into said far off-state for a sufficient time, during each application, to modify the dependency of off-state current flow in said field effect transistor when in the off-state condition.

5. The method as recited in claim 4 wherein step b) applies said far off-state voltage between said drain region and said gate electrode, and said source region and said gate electrode, in any order of application.

6. The method as recited in claim 5 wherein said field effect transistor is configured as a thin film transistor and said source region and drain region are configured into a polycrystalline semiconductor layer.

7. A field effect transistor circuit comprising:

a) a gate electrode positioned on one surface of a dielectric layer;

b) a silicon layer separated from said gate electrode by said dielectric layer and including a drain region and a source region;

c) bias means connected to said gate electrode, and at least one of said source region and drain region for applying, between at least said gate electrode and said drain region, a potential which causes a conduction channel in said silicon layer to be driven into a far off-state conduction condition for a predetermined period of time, to achieve an alteration of off-state current flow in said transistor.

8. The field effect transistor circuit recited in claim 7, wherein said bias means further applies, between said gate electrode and said source region, a potential which causes said conduction channel to be driven into said far off-state conduction condition for a predetermined period of time.

* * * * *

UNITED STATES PATENT AND TRADEMARK OFFICE

CERTIFICATE OF CORRECTION

PATENT NO. : 5,945,866
APPLICATION NO. : 08/807611
DATED : August 31, 1999
INVENTOR(S) : Stephen J. Fonash et al.

It is certified that error appears in the above-identified patent and that said Letters Patent is hereby corrected as shown below:

Column 1, Line 9, after priority claim, and before "FIELD OF THE INVENTION" insert the following:

--This invention was made with Government support under Contract No. F33615-94-1-1464, awarded by the United States Air Force for the Defense Advanced Research Projects Agency (DARPA). The Government has certain rights in the invention.--

Signed and Sealed this

Fourteenth Day of April, 2009

John Doll

JOHN DOLL
*Acting Director of the United States Patent and Trademark Office*